United States Patent [19]

Shiber

[11] 4,143,728

[45] Mar. 13, 1979

[54] MOTORIZED SKATEBOARD

[76] Inventor: Samuel Shiber, P.O. Box 1302, Des Plaines, Ill. 60018

[21] Appl. No.: 757,459

[22] Filed: Jan. 6, 1977

[51] Int. Cl.[2] ..... A63C 17/00

[52] U.S. Cl. ..... 180/1 G; 180/21; 280/11.11 E; 280/87.04 A

[58] Field of Search ..... 180/1 G, 16, 21, 52; 280/11.11 R, 11.11 E, 87.04 R, 87.04 A

[56] References Cited

U.S. PATENT DOCUMENTS

| | | | |
|---|---|---|---|
| 1,607,236 | 11/1926 | Bumstead | 180/2 UX |
| 2,218,510 | 10/1940 | Albertson et al. | 180/25 R |
| 2,709,327 | 5/1955 | Heth | 180/1 F |
| 3,424,475 | 1/1969 | Gibson | 180/52 X |
| 4,060,253 | 11/1977 | Oldendorf | 280/87.04 A |

OTHER PUBLICATIONS

Skateboarder, vol. 2, No. 6, Aug. 1976, "41st Avenue Skateboards".

*Primary Examiner*—John A. Pekar
*Assistant Examiner*—Michael Mar
*Attorney, Agent, or Firm*—Samuel Shiber

[57] ABSTRACT

A motorized skateboard having a drive axle with a drive wheel coupled to a prime mover and an idler wheel, wherein the drive wheel is made to support more weight than the idler wheel in order to improve the traction of the skateboard.

1 Claim, 4 Drawing Figures

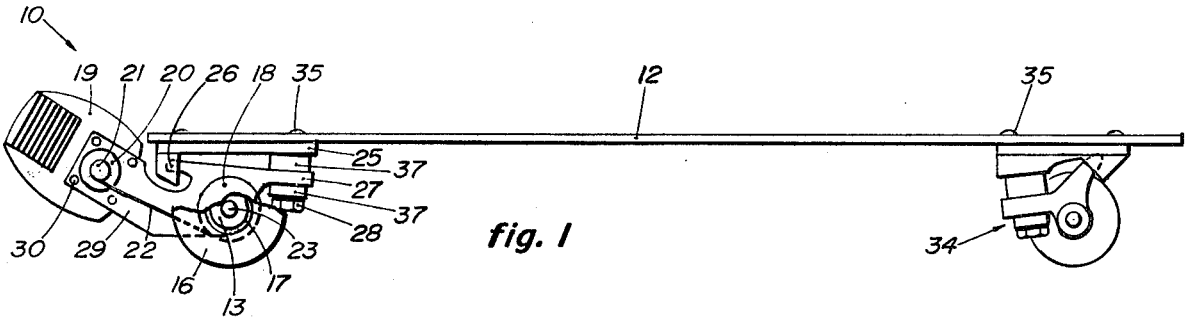
fig. 1
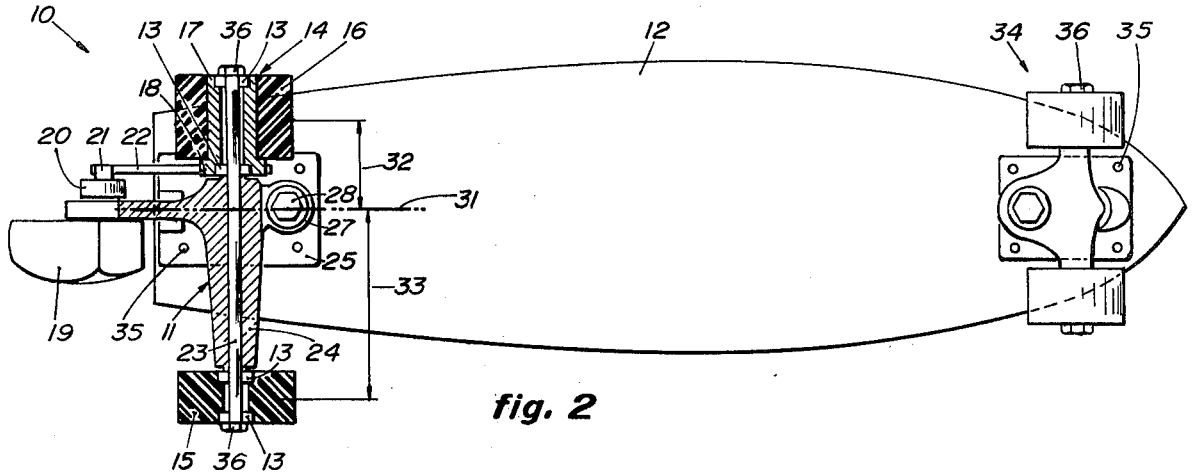
fig. 2
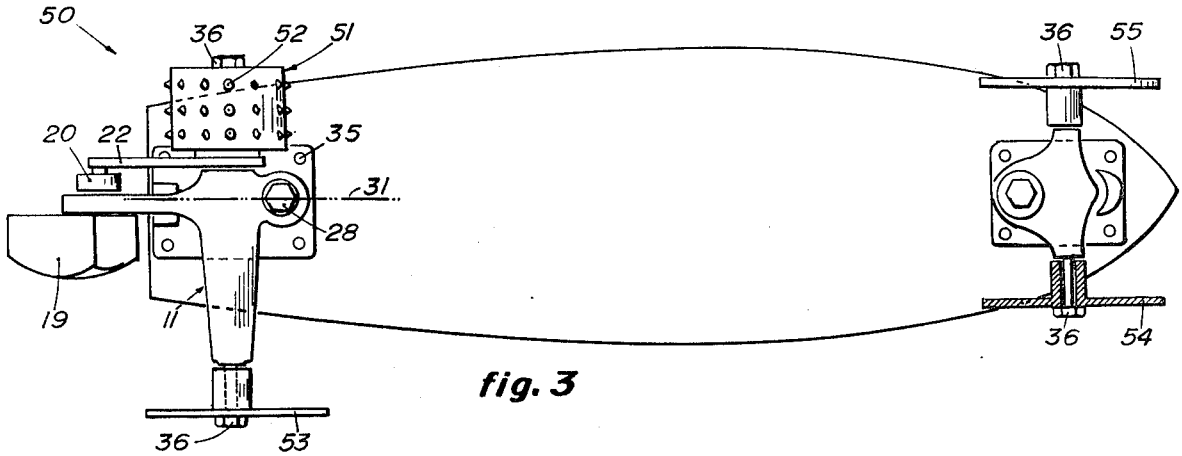
fig. 3
fig. 4

MOTORIZED SKATEBOARD

BACKGROUND OF THE INVENTION

This invention relates to motorized skateboard type of devices. Presently, skateboarding is limited to skating one way down a paved hill which is often hard to find. The present invention permits skateboarding on any paved surface, and where the terrain is hilly, up and down the hill. In addition, power skateboarding combines the excitement of controlling the propelling power with the inherent aspects of conventional skateboarding such as holding balance and steering by body and limbs manipulation.

SUMMARY OF THE INVENTION

A motorized skateboard uses one conventional skateboard axle and wheels, preferably as a front axle and a rear drive axle, each axle having a right and a left wheel. To obtain good traction it is preferred to couple both rear wheels to a prime mover, which can be for example, a small gasoline engine; however, such coupling has to be done in a manner which will allow the two rear wheels to rotate at a different tangential speeds, otherwise severe braking and overheating of the rear wheels will occur during the tight turns which typify the sport of skateboarding. Proper differentiation can be achieved by driving the rear wheels through an automotive type differential, or through a live axle to which each wheel is connected through a one way clutch, but any such drive system inherently adds cost and complexity.

The primary object of the present invention is to provide a drive system that will generate adequate traction, in which only one wheel will be coupled to the engine while the other wheel will be free to rotate at a different tangential speed, allowing such system to be simple and reliable in operation and inexpensive to produce.

BRIEF DESCRIPTION OF THE FIGURES

FIG. 1 shows a partially sectioned side view of a first embodiment of a motorized skateboard in which a part of a drive wheel, a front wheel and a part of a drive belt have been removed to show the axles' structure, FIG. 2 is a partially sectioned bottom view of the motorized skateboard of FIG. 1, FIG. 3 shows a partially sectioned bottom view of a second embodiment of a motorized skateboard which was modified to skate on ice, by equipping the drive wheel with studs and by replacing the non-driving wheels with small skate-blades, and FIG. 4 shows a side view of a skate-blade that may be used for modifying a motorized skateboard according to FIG. 3.

DETAILED DESCRIPTION OF THE FIGURES

Same parts in the first and second embodiments will be indicated by same numerals.

FIGS. 1 and 2 show a motorized skateboard 10 having a drive system comprising a drive axle 11 supporting a rear end of a skateboard board 12. The axle rotatibly supports, through ball-bearing 13, a drive wheel 14 on one side, and an idler wheel 15 on its other side. The drive wheel 14 is made of a resilient tire 16 bonded to a metal hub 17 which is affixed to a pully 18. The drive wheel 14 is coupled to a prime mover in the form of a small internal combustion engine 19 through a centrifugal clutch 20 having a pully 21, a belt 22 and the pully 18. The engine's power output may be controlled by a system (not shown) which is described in my copending U.S. patent application (Ser. No. 683,481) now U.S. Pat. No. 4,069,881 which is herein incorporated by reference. The drive axle 11 comprises an axle 23, preferably made of steel, which is supported in an axle hanger 24 connected to a base 25 through its pivot tip 26 and its pivot washer 27 which is attached to the base 25 by a bolt 28, squeezing the pivot washer between two action bushings 37 made of resilient material. An extension of the axle hanger 24 forms an engine bracket 29 to which the engine is attached by four bolts 30. Thus, the pivot tip 26 and the pivot washer 27 form a pivoting connection between the axle 11 and the rest of the skateboard. This pivoting connection is indicated on FIGS. 2 and 3 by a phantom line 31.

The drive wheel 14 and the idler wheel 15 are at unequal distances 32 and 33, respectively, from the pivoting connection 31. Assuming that the distance 33 is twice as long as the distance 32, then the distribution of the load that is supported by the drive axle 11 will be approximately two thirds to the drive wheel 14 and one third to the idler wheel 15. Such favoring of the drive wheel 14 in the load distribution usually assures adequate traction even when some occasional weight biasing from the drive wheel 14 to the idler wheel 15 occurs due to the rider tilting the board 12 downwards towards the idler wheel 14, or due to a wheel's and/or ground's geometry; a further increase of the ratio between the distances 33 and 32 will further improve the traction but may have negative cosmetic, structural and cost effects, and the exact ratio is a designer's choise which also depends on additional factors such as the size of the engine and the intended use of the motorized skateboard, whether it is for competition or for recreational usage, etc.

As previously discussed, the skateboard transmits a load to the drive axle 11 which distributes this load between the wheels 14 and 15, which in turn transmits this load to the ground through a contact area, or a foot print, that the wheels establish with the ground. For the purpose of physical calculations the load and the reaction force to it that are exchanged between a wheel and the ground throughout the wheel's foot print can be substituted by a single resultant force. In cylindrical wheels of the type illustrated in FIG. 2 the resultant force line of action passes through or close to the middle of the wheel, and that is why the distances 32 and 33 are indicated on FIG. 2 to the middle of the wheels 14 and 15, respectively. With other types of wheels and/or tires configurations or due to flexible axles the line of action may shift within the wheel's foot print, but obviously, by moving the whole wheel away from the pivoting connection 31 the line of action will follow. In any case, for the purpose of this discussion the more accurate way to measure a distance to a wheel is to measure the distance to the resultant force line of action.

A conventional skateboard axle and wheels assembly 34 supports a front end of the board 12. Structural details of such axles can be found in the "Complete Skateboard Repair Manual" by Robert L. Halle which is published and sold by Holly Enterprises, P.O. Box 572, Santee, Calif., and which is herein incorporated by reference.

FIG. 3 shows a motorized skateboard 50 modified to skate on ice by equipping its drive wheel 51 with metal studs 53 for traction on ice and by replacing its non driving wheels with skate-blades 53, 54 and 55, of the type shown in FIG. 4. Since in other respects the two embodiments are similar further discussion of the second embodiment seems unnecessary.

In both embodiments screws 35 hold the axles assemblies to the board 12 and nuts 36 secure the wheels and skate-blades to their respective axles.

I claim:

1. A motorized skateboard, having a first end and a second end, comprising in combination:

a skateboard board, an axle supporting a first end of said board, a drive axle supporting a second end of said board through a pivoting connection, said drive axle having a first end and a second end, a drive wheel rotateably supported on said first end of said drive axle, an idler wheel rotateably supported on said second end of said drive axle, and a prime mover coupled to said drive wheel, the improvement wherein the distance between said pivoting connection and said idler wheel is substantially longer than the distance between said pivoting connection and said drive wheel so that the weight supported by said drive wheel is substantially greater than the weight supported by said idler wheel for substantially increasing traction of said drive wheel.

* * * * *